US009410318B2

(12) United States Patent
Maley et al.

(10) Patent No.: US 9,410,318 B2
(45) Date of Patent: Aug. 9, 2016

(54) HOUSING CONSTRUCTION SYSTEM

(71) Applicant: IG Creative Solutions Inc., Fraser, MI (US)

(72) Inventors: Paul J. Maley, Troy, MI (US); Robert N. Maley, Fraser, MI (US); Laurence R. Maley, Shelby Township, MI (US)

(73) Assignee: IG Creative Solutions, Inc., Warren, MI (US)

( * ) Notice: Subject to any disclaimer, the term of this patent is extended or adjusted under 35 U.S.C. 154(b) by 0 days.

(21) Appl. No.: 14/474,092

(22) Filed: Aug. 30, 2014

(65) Prior Publication Data

US 2015/0135625 A1 May 21, 2015

Related U.S. Application Data

(63) Continuation of application No. 13/955,621, filed on Jul. 31, 2013, now Pat. No. 8,820,018, which is a continuation of application No. 12/901,777, filed on Oct. 11, 2010, now abandoned, which is a continuation-in-part of application No. 11/214,615, filed on Aug. 30, 2005, now Pat. No. 7,810,294.

(60) Provisional application No. 60/614,406, filed on Sep. 29, 2004.

(51) Int. Cl.

| | |
|---|---|
| ***E04B 9/00*** | (2006.01) |
| ***E04B 9/10*** | (2006.01) |
| ***E04B 9/06*** | (2006.01) |
| ***E04B 9/18*** | (2006.01) |
| ***E04B 9/26*** | (2006.01) |
| ***E04F 13/08*** | (2006.01) |
| ***E04F 19/02*** | (2006.01) |
| ***E04F 19/06*** | (2006.01) |

(Continued)

(52) U.S. Cl.

CPC . *E04B 9/10* (2013.01); *E04B 9/006* (2013.01); *E04B 9/064* (2013.01); *E04B 9/065* (2013.01); *E04B 9/18* (2013.01); *E04B 9/26* (2013.01); *E04F 13/0803* (2013.01); *E04F 13/0812* (2013.01); *E04F 19/022* (2013.01); *E04F 19/06* (2013.01); *E04F 19/061* (2013.01); *E04F 19/062* (2013.01); *E04F 19/066* (2013.01); *F21S 8/02* (2013.01); *F21V 21/04* (2013.01); *F21Y 2101/02* (2013.01)

(58) Field of Classification Search

CPC ..... E04B 9/06; E04B 9/064; E04B 9/067; E04B 9/068; E04B 9/10; E04B 9/12; E04B 9/127; E04B 9/18

USPC ..... 52/220.6, 386, 459, 489.1, 506.01, 52/506.05–506.08, 506.09, 511

See application file for complete search history.

(56) References Cited

U.S. PATENT DOCUMENTS

| | | | |
|---|---|---|---|
| 1,854,438 | A | 4/1932 | Wray |
| 2,059,483 | A | 11/1936 | Parsons |

(Continued)

*Primary Examiner* — William Gilbert

(74) *Attorney, Agent, or Firm* — Harness, Dickey & Pierce, P.L.C.

(57) ABSTRACT

A wall surfacing system for providing a secondary ceiling or wall covering structure adjacent a primary structure. The system provides a plurality of elongated structural support rails, each of these support rails have a coupling web with a bearing surface for attachment to the primary structure, a coupling mechanism, and a portion integrally formed with and connecting the coupling web to the coupling mechanism. A plurality of generally planar surface panels are provided. Each panel has an integral interlocking member configured to mate with the coupling mechanism on the support rail. The elongated support rails are secured to primary structures, thereby extending the surface panels to form an aesthetically pleasing covered surface.

12 Claims, 23 Drawing Sheets

(51) Int. Cl.

| | |
|---|---|
| *F21S 8/02* | (2006.01) |
| *F21V 21/04* | (2006.01) |
| *F21Y 101/02* | (2006.01) |

(56) References Cited

U.S. PATENT DOCUMENTS

| | | | | |
|---|---|---|---|---|
| 2,066,205 | A | | 12/1936 | Keating |
| 2,164,261 | A | | 6/1939 | Small |
| 2,389,171 | A | | 11/1945 | Urbain |
| 2,403,881 | A | | 7/1946 | Tarbox |
| 2,490,663 | A | | 12/1949 | VanUum et al. |
| 2,734,126 | A | | 2/1956 | Kruger |
| 2,841,255 | A | | 7/1958 | Kemp |
| 3,037,590 | A | | 6/1962 | Pavlecka |
| 3,082,487 | A | | 3/1963 | Fowler et al. |
| 3,471,982 | A | | 10/1969 | Strozewski |
| 3,475,869 | A | | 11/1969 | Jahn |
| 3,685,235 | A | | 8/1972 | Lang |
| 3,694,981 | A | | 10/1972 | Cremer et al. |
| 3,705,471 | A | | 12/1972 | Allen |
| 3,708,927 | A | | 1/1973 | Cohen |
| 3,731,447 | A | | 5/1973 | Dawdy et al. |
| 3,906,697 | A | | 9/1975 | Rijnders |
| 3,936,990 | A | | 2/1976 | Garrison et al. |
| 3,946,529 | A | * | 3/1976 | Chevaux ..... 150/105 |
| 3,992,846 | A | | 11/1976 | Tantlinger |
| 3,998,018 | A | | 12/1976 | Hodges |
| 4,361,994 | A | | 12/1982 | Carver |
| 4,406,104 | A | | 9/1983 | Beck et al. |
| 4,452,021 | A | | 6/1984 | Anderson |
| 4,475,325 | A | | 10/1984 | Veldhoen |
| 4,492,066 | A | | 1/1985 | LaLonde |
| 4,545,161 | A | | 10/1985 | Baumann |
| 4,580,374 | A | | 4/1986 | Quinnell |
| 4,640,064 | A | | 2/1987 | Goodworth, II |
| 4,646,506 | A | | 3/1987 | Slapsys |
| 4,696,142 | A | | 9/1987 | Mieyal et al. |
| 4,720,946 | A | | 1/1988 | Pagliarello |
| 4,730,428 | A | | 3/1988 | Head et al. |
| 4,744,188 | A | | 5/1988 | Ahren |
| 4,760,677 | A | | 8/1988 | Nassof |
| 4,794,745 | A | | 1/1989 | Platt et al. |
| 4,845,912 | A | | 7/1989 | Baker |
| 4,905,952 | A | | 3/1990 | Pinquist |
| 4,926,606 | A | | 5/1990 | Hanson |
| 4,932,186 | A | | 6/1990 | Jahn |
| 5,004,192 | A | | 4/1991 | Handler |
| 5,056,287 | A | | 10/1991 | Weber |
| 5,154,031 | A | | 10/1992 | Wall |
| 5,182,893 | A | | 2/1993 | Goodworth |
| 5,201,787 | A | | 4/1993 | LaLonde et al. |
| 5,215,284 | A | | 6/1993 | Hungerford |
| 5,265,393 | A | | 11/1993 | Bischel et al. |
| 5,287,668 | A | | 2/1994 | Dall et al. |
| 5,369,928 | A | | 12/1994 | Goodworth |
| 5,377,463 | A | | 1/1995 | Howe |
| 5,619,833 | A | | 4/1997 | Neff |
| 5,657,598 | A | | 8/1997 | Wilbs et al. |
| 5,678,367 | A | | 10/1997 | Kline |
| 5,687,527 | A | | 11/1997 | Bikard et al. |
| 5,692,345 | A | | 12/1997 | Mogaki et al. |
| 5,794,397 | A | | 8/1998 | Ludwig |
| 5,809,730 | A | * | 9/1998 | Renz ..... 52/506.09 |
| 5,845,447 | A | | 12/1998 | Bodine et al. |
| 5,893,250 | A | | 4/1999 | Benvenuto et al. |
| 5,979,134 | A | | 11/1999 | Neff |
| 6,000,190 | A | | 12/1999 | Richardson |
| 6,050,534 | A | | 4/2000 | Andrews |
| 6,101,777 | A | | 8/2000 | Bodine et al. |
| 6,205,732 | B1 | | 3/2001 | Rebman |
| 6,205,733 | B1 | | 3/2001 | LaLonde |
| 6,324,797 | B1 | | 12/2001 | Fago et al. |
| 6,351,920 | B1 | | 3/2002 | Hopkins et al. |
| 6,389,771 | B1 | | 5/2002 | Moller |
| 6,397,532 | B1 | | 6/2002 | Shipman et al. |
| 6,467,228 | B1 | | 10/2002 | Wendt et al. |
| 6,574,936 | B1 | | 6/2003 | Anderson, Sr. |
| 6,588,165 | B1 | | 7/2003 | Wright |
| 6,779,315 | B1 | | 8/2004 | Bongio et al. |
| 6,892,500 | B2 | | 5/2005 | Zaborowski |
| 6,968,661 | B2 | | 11/2005 | Kopish et al. |
| 6,993,875 | B2 | * | 2/2006 | Rudduck ..... 52/474 |
| 7,096,633 | B1 | | 8/2006 | Bowen |
| 7,168,213 | B2 | | 1/2007 | Rudduck |
| 7,592,537 | B1 | | 9/2009 | West |
| 7,810,294 | B2 | | 10/2010 | Maley et al. |
| 8,820,018 | B2 | | 9/2014 | Maley et al. |
| 2002/0035811 | A1 | | 3/2002 | Heuel |
| 2002/0083655 | A1 | | 7/2002 | Paul et al. |
| 2002/0152704 | A1 | | 10/2002 | Thompson et al. |
| 2003/0046890 | A1 | | 3/2003 | Lynch et al. |
| 2004/0148894 | A1 | | 8/2004 | Kelley et al. |
| 2004/0168382 | A1 | * | 9/2004 | Rudduck ..... A47B 91/02 52/238.1 |
| 2005/0000182 | A1 | | 1/2005 | Martin et al. |
| 2005/0257476 | A1 | | 11/2005 | Saidoo et al. |
| 2008/0134594 | A1 | | 6/2008 | Ness |
| 2011/0072744 | A1 | | 3/2011 | Maley et al. |

* cited by examiner

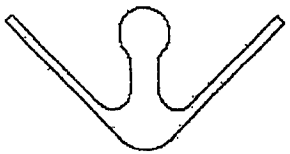
Fig. 18a
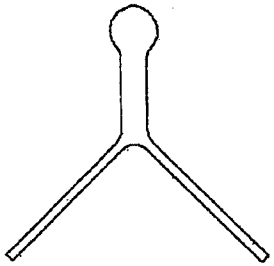
Fig. 18b
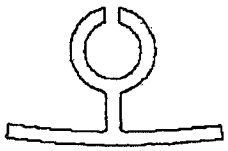
Fig. 18c
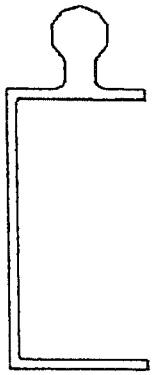
Fig. 18d
Fig. 18e
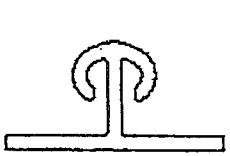
Fig. 18f
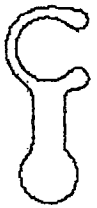
Fig. 18g
Fig. 18h
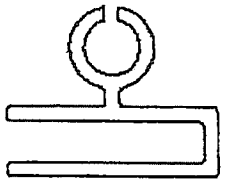
Fig. 18i

HOUSING CONSTRUCTION SYSTEM

CROSS-REFERENCE TO RELATED APPLICATIONS

This application is a continuation application of U.S. patent application Ser. No. 12/901,777, filed on Oct. 11, 2010, which is a continuation-in-part application of U.S. patent application Ser. No. 11/214,615 filed on Aug. 30, 2005, which claims the benefit of U.S. Provisional Application No. 60/614,406, filed on Sep. 29, 2004. The entire disclosure of each of the above applications is incorporated herein by reference.

FIELD OF THE INVENTION

The present invention relates to a housing construction system and, particularly, to a system for providing drop ceilings or wall covering structures.

BACKGROUND OF THE INVENTION

A number of different systems and structures exist for providing a drop or suspended ceiling or wall structures in a room. As will be appreciated by those skilled in the art, suspended ceilings are assembled such that they are spaced a predetermined distance below ceiling joists, in contrast to ceilings that are mounted directly on strips attached to a ceiling joist or an original ceiling structure. Suspended ceilings generally comprise a plurality of individual ceiling tiles. The individual tiles may take a number of overall geometries, but are typically rectangular or square. Many different materials are used to fabricate ceiling tiles, such as pressed fibrous materials or synthetic polymers. In particular, it is known to use synthetic resins to form precast ceiling tiles that are lightweight, washable and durable. These precast tiles may be provided with an embossed or textured surface to add an aesthetically pleasing appearance to the tile surface that is exposed to view when installed.

Many of the most common drop ceiling systems currently in use require a complicated track system that aligns and supports individual tiles. It will be appreciated that for proper installation of the tiles, the grid and tiles must meet a number of geometrical requirements. That is, the faces of the tiles must generally lie in a single plane so that a uniform surface is obtained. The tiles must generally be positioned in orderly arrays of rows and columns, although in some configurations, alternating rows or columns may be offset a predetermined uniform distance. In any event, the ceiling tiles are generally arranged such that a uniform pattern is created. In addition, there must be means by which the tiles can accommodate variances in the geometry of the ceiling space at corners, pillars and the like, as well as around the perimeter of the ceiling space. These systems are complicated and require substantial amounts of time to assemble.

SUMMARY OF THE INVENTION

In one aspect, the present invention provides a construction kit for securing a secondary ceiling structure to a base member. The kit includes a plurality of elongated structural support members, each having a base coupling portion with a mounting surface configured to fixedly attach to the base member. A coupling mechanism is integrally formed with and longitudinally extends along the length of the support member. A plurality of substantially planar wall structures are provided having an interior major surface and an opposite exterior major surface. At least one outwardly facing wall structure coupling mechanism is integrally formed with the interior major surface of the wall structures and is configured to interlock with the support member coupling mechanism, thereby securing the wall structures to the support members.

In another aspect, the present invention provides a wall surfacing system for providing a secondary ceiling or wall covering structure adjacent a primary structure. The system includes a plurality of elongated structural support rails, each support rail having a coupling web with a bearing surface for attachment to the primary structure, a coupling mechanism, and a fixed length stringer portion integrally formed with and connecting the coupling web to the coupling mechanism. A plurality of generally planar surface panels are provided. Each panel has an integral interlocking member configured to mate with the coupling mechanism on the support rail. The elongated support rails are secured to primary structures, thereby suspending the surface panels to form an aesthetically pleasing covered surface.

As such, it is an object of the present invention to provide an interior surfacing system, such as a suspended ceiling or wall system that is easy to install and provides a generally uninterrupted interior surface.

The foregoing and other objects, features and advantages of the invention will be apparent from the following more particular description in the preferred embodiments of the invention as illustrated in the accompanying drawings. Further areas of applicability of the present invention will become apparent from the detailed description provided hereinafter. It should be understood that the detailed description, drawings, and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 18*a*-18*i* illustrate cross-sections of various couplings, corner members and trim members;

FIGS. 25*a* and 25*b* represent a modular light member configured to couple to the ceiling wall members described herein.

DETAILED DESCRIPTION OF THE PREFERRED EMBODIMENTS

The following description of the preferred embodiments is merely exemplary in nature and is in no way intended to limit the invention, its application, or uses.

Figure 1:
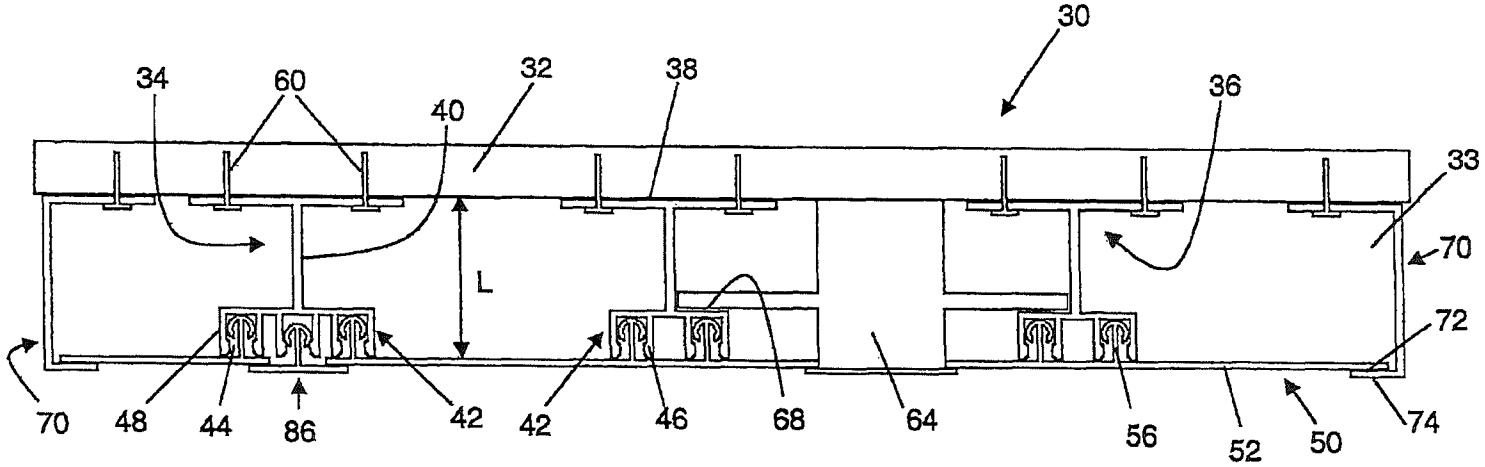
FIG. 1 represents one embodiment of a drop ceiling system according to the teachings of the present invention.
Figure 2:
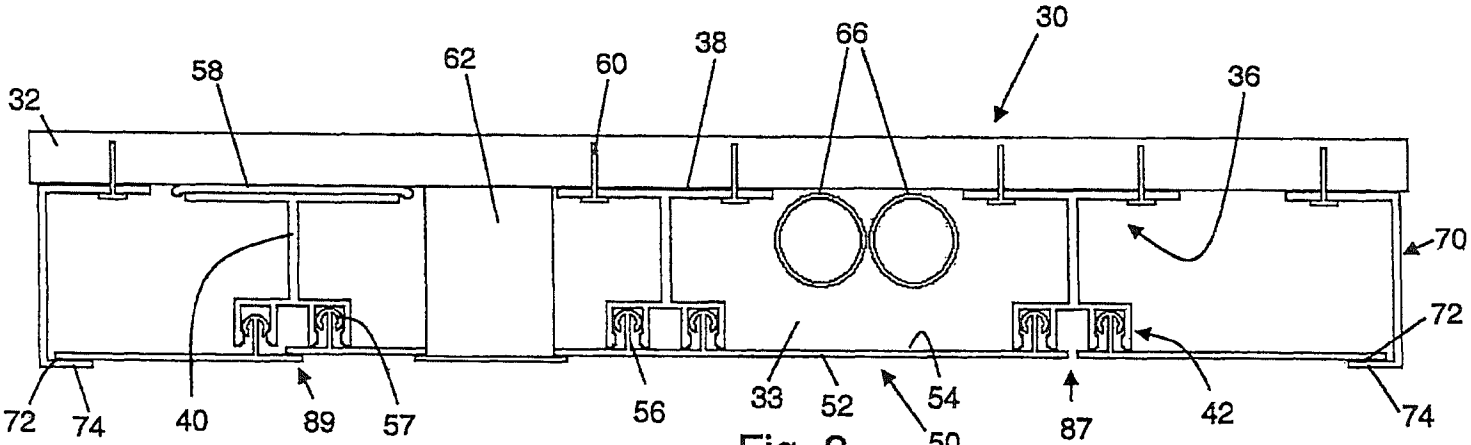
FIG. 2 represents an alternate drop ceiling system according to the teachings of the present invention.

The present invention relates to an interior housing construction system for providing drop ceilings and other wall covering structures. FIGS. 1 and 2 generally represent a ceiling construction system 30 configured to be coupled to a primary structure or base member 32. The base member 32 may include several cross-joist members, beams or other similar construction members as is known in the art for ceilings and walls. It is envisioned that the base member 32 can be brick, stone, block, wood, plaster, drywall, wallboard, or similar construction materials as is known in the art. A plurality of elongated structural support members, or rails 34, are used to support a plurality of substantially planar wall structures, or surface panels 50 at a fixed length L away from the base member 32.

Figure 3:
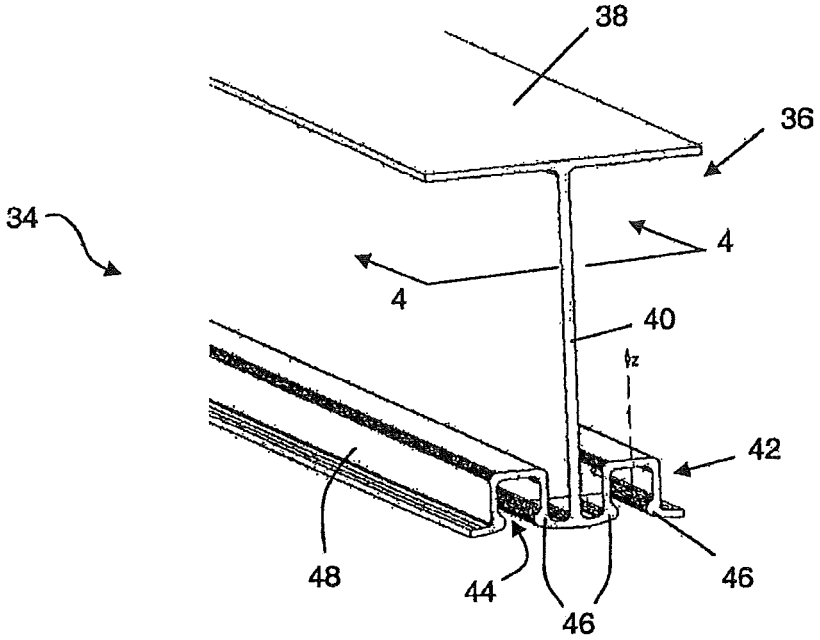
FIG. 3 illustrates a partial perspective view of a support member according to one embodiment of the present invention.
Figure 4:
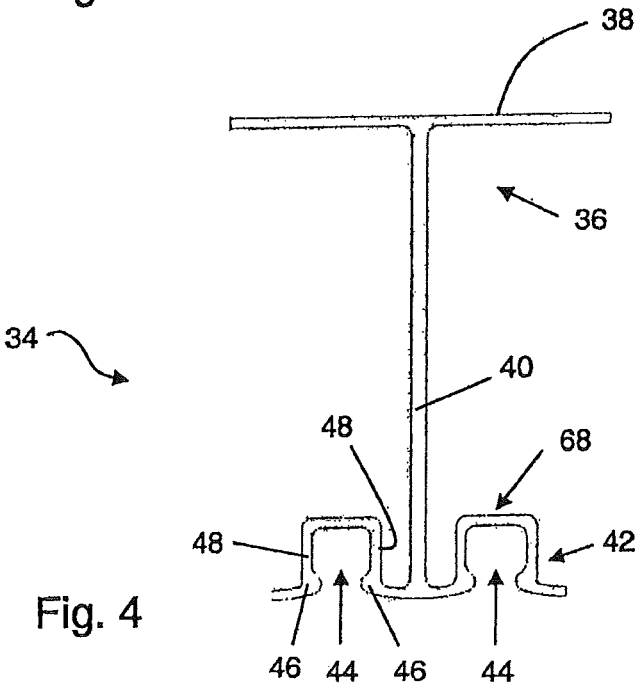
FIG. 4 is a cross-sectional view of FIG. 3 taken along the line 4-4.

FIG. 3 illustrates a partial perspective view of a support member 34 according to one embodiment of the present invention. FIG. 4 is a cross-sectional view of FIG. 3 taken along the line 4-4. As shown, the support members 34 preferably have a base coupling portion, or coupling web 36, that has a substantially planar bearing or mounting surface 38. In various embodiments, a stringer member 40, is integrally formed with and disposed between the base coupling portion 36 and a support member coupling mechanism 42. The stringer member 40 is generally perpendicular to the mounting surface 38 forming a substantially T-shaped or L-shaped base coupling portion 36, although it should be understood that any suitable shape could be used. Preferably, the stringer member 40 is of a fixed length, although it may be desired to have variable lengths depending upon the desired finished appearance and the shape or orientation of the base member 32. In various embodiments, the support member coupling mechanism 42 defines at least one longitudinal receiving channel 44 having integral locking projections, or retaining teeth members 46. In one embodiment, at least a portion of one of the walls 48 of the receiving channel 44 is deformable and configured to receive a corresponding male coupling member.

In various embodiments, the support members 34 are monolithic in design and extruded from PVC or a similar material. One presently preferred material includes such a PVC compound provided by Georgia Gulf Chemicals & Vinyls, LLC, of Madison, Miss. It should be understood that various other suitable thermoplastics including, but not limited to, nylons can be used. It should also be noted that the support members 34 of the present invention have a cross-section that allows for the extrusion of predetermined lengths. This includes various optional trim members that will be discussed in more detail below, including end pieces, interior corner pieces, exterior corner pieces, center seam members, soffit covering pieces, and the like.

Figure 5:
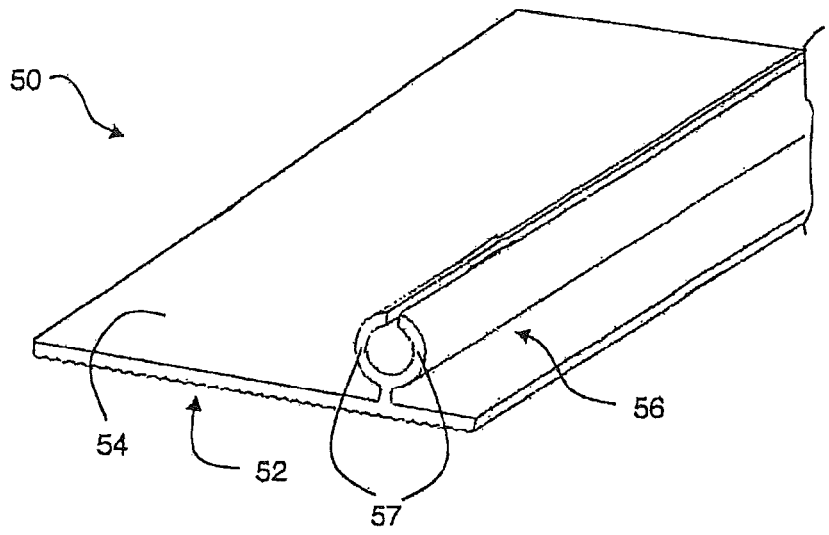
FIG. 5 illustrates a partial perspective view of a substantially planar ceiling or wall covering structure.
Figure 6:
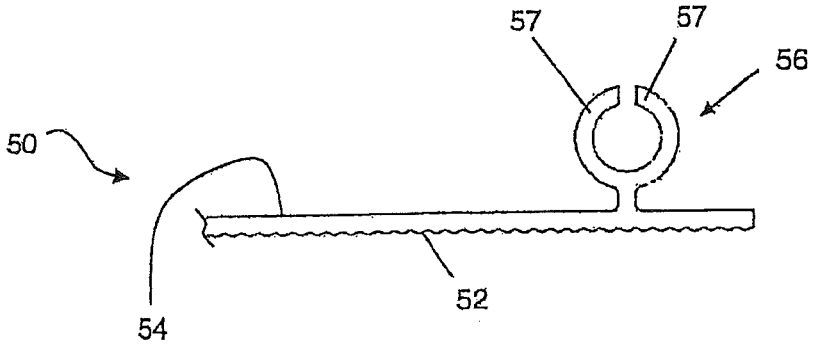
FIG. 6 is a cross-sectional view of FIG. 5 taken along the line 6-6.

FIG. 5 illustrates a partial perspective view of a substantially planar ceiling or wall covering structure 50. FIG. 6 is a cross-sectional view of FIG. 5 taken along the line 6-6. As shown, the wall structure 50 has a front face, or exterior major surface 52, and a coupling face, or interior major surface 54, that has at least one outwardly facing wall structure coupling mechanism 56 configured to interlock with the support member coupling mechanism 42, thereby securing the wall structure 50 to the support member 34. In one embodiment, the wall structure coupling mechanism 56 is integral with and extends the entire length of the wall structure 50. In another embodiment, the coupling mechanism 56 may be discontinuous or located at an end region of the wall structure 50. The wall structure 50 may be made of PVC material, pegboard, wood laminate, foam, or other similar construction material. In one embodiment, the wall structure 50 is extruded and can be custom manufactured or cut to size. In various embodiments, the exterior major surface 52 is textured or may have a veneer or other finished surface. In various other embodiments, the exterior major surface 52 can be painted or finished with a wallpaper or suitable wall covering, if so desired.

With renewed reference to FIGS. 1 and 2, in various embodiments, the support member 34 is coupled to the base member 32 with an appropriate strength adhesive 58 or mechanical fasteners 60 such as screws or nails. As described above, preferably the support structure coupling mechanism 42 is formed having a pair of generally parallel, deformable walls 48 that are configured to engage a corresponding wall structure coupling mechanism 56. In one embodiment, the wall structure coupling mechanism 56 includes a pair of deformable members 57 that are configured to be inserted between the pair of generally parallel wall members 48. In various other embodiments, the coupling mechanism 56 is non-deformable and it should be understood that the mechanism 56 can be of a variety of shapes and sizes, such as hook or J-shaped.

In various aspects of the present invention, the wall structure members 50 are suspended below the base member 32 to form an aesthetically pleasing interior surface. Within the predefined distance, or cavity 33, between the base member 32 and the wall surface structures 50, various components or auxiliary devices can be encapsulated or hidden from view. Non-limiting examples include HVAC venting and ducts 62, recessed or canister lights 64, various pipes 66, such as water and gas, and other items such as phone wires, speaker wires, cable wires, and the like (not shown). It is envisioned that the wall surface structures 50 are made of materials and arranged in configurations which allow for the cutting of the wall surface structure 50 to allow ducts 62 or lights 64 to breach the wall surface structures 50. In certain embodiments, the support members 34 are designed having means for supporting such auxiliary devices with an additional supporting surface 68 or the like. The support members can also be provided with clips or areas to rest lights 64, cables, speaker wires, phone wires, or the like.

Figure 7:
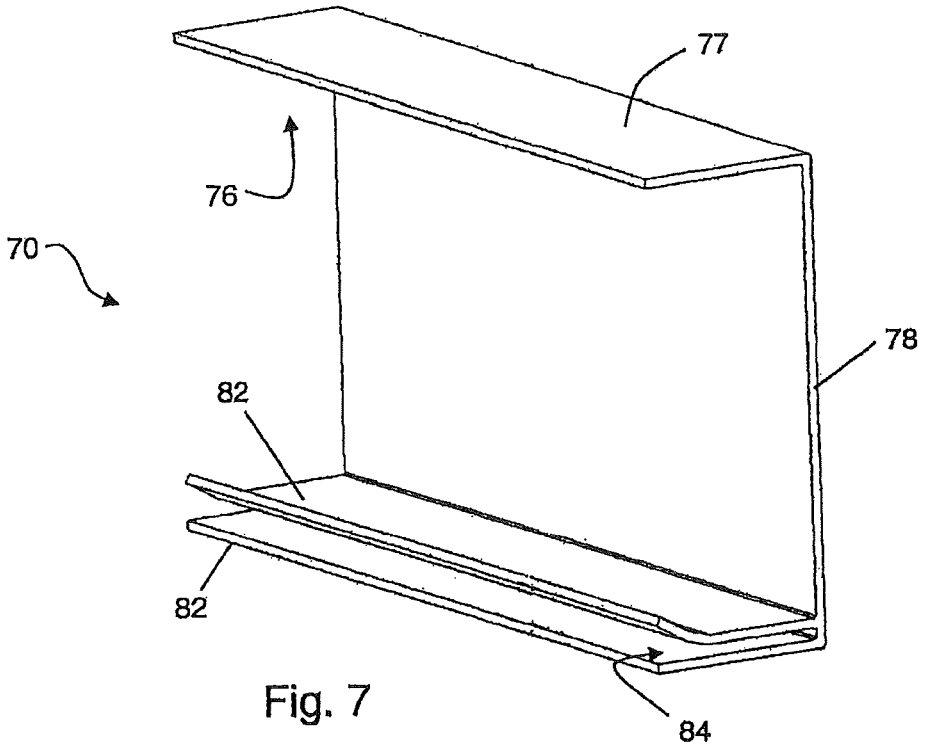
FIG. 7 illustrates a perspective view of an end piece according to one embodiment of the present invention.
Figure 8:
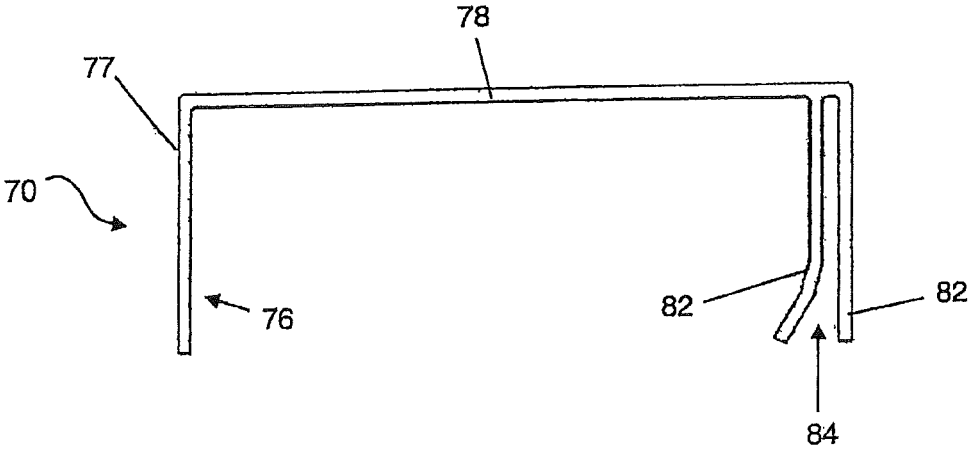
FIG. 8 is a cross-sectional view of FIG. 7 taken along the line 8-8.

In various embodiments, it is desirable to use trim members, such as end pieces 70, which are used to support the wall surface structures 50 along end areas such as walls. As shown in FIGS. 1 and 2, an edge portion 72 of the wall structure 50 can be supported by a support surface such as a flange 74. FIG. 7 illustrates an alternative design of an end piece 70. FIG. 8 is a cross-sectional view of FIG. 7 taken along the line 8-8. The end piece 70 includes a base coupling portion 76 with a mounting surface 77 configured to be secured to the base member 32. The base coupling portion has an integral stringer member 78 connected to an end piece coupling mechanism 80. As shown in one embodiment, the end piece coupling mechanism consists of two generally parallel members 82 forming an elongated receiving channel 84 configured to slidingly receive and secure an edge 72 of the wall structure 50.

Figure 9:
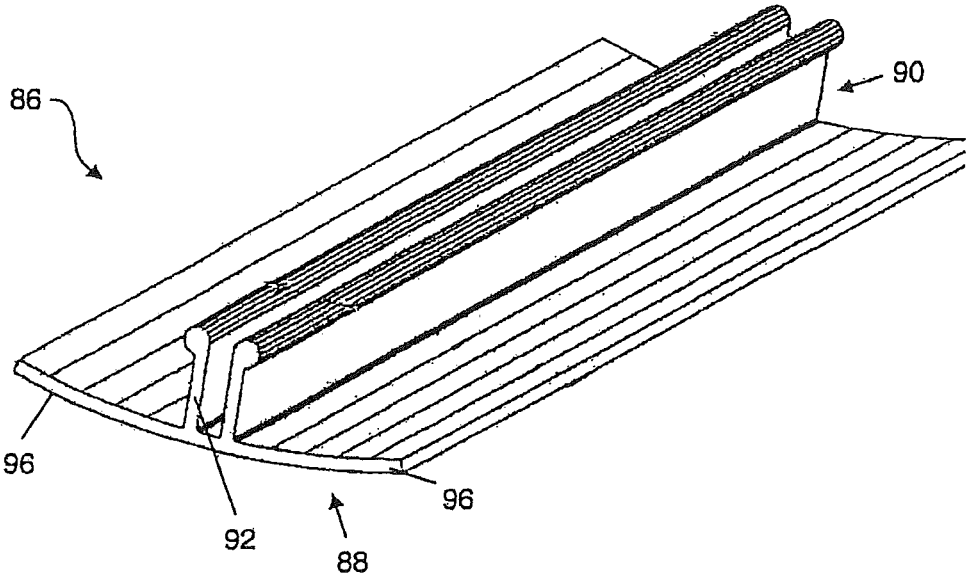
FIG. 9 illustrates a perspective view of a center seam sealing member according to one embodiment of the present invention.
Figure 10:
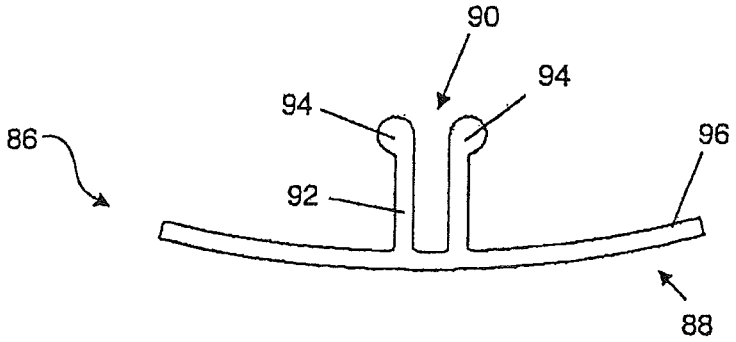
FIG. 10 is a cross-sectional view of FIG. 9 taken along the line 10-10.

Additionally shown in FIG. 1 is a center seam member 86 optionally used to any cover any gaps 87 or seam areas between adjacent surface structures 50. FIG. 9 illustrates a partial perspective view of one embodiment of a center seam sealing member 86. FIG. 10 is a cross-sectional view of FIG. 9 taken along the line 10-10. As shown, the seam sealing member 86 generally comprises a flat or slightly curved cover portion 88 having an integrally formed seam coupling mechanism 90. In one embodiment, the coupling mechanism 90 includes two substantially parallel coupling members 92 that are preferably deformable and optionally having at least one interlocking projection 94 to couple with the support member coupling mechanism 42. Once in position, the ends 96 of the cover member 88 preferably abut and/or support the edges 72 of the wall structures 50 for an aesthetically pleasing sealed finish. In certain embodiments, it may be desirable to simply provide an overlap 89 of wall structures 50 as shown in FIG. 2.

Figure 11:
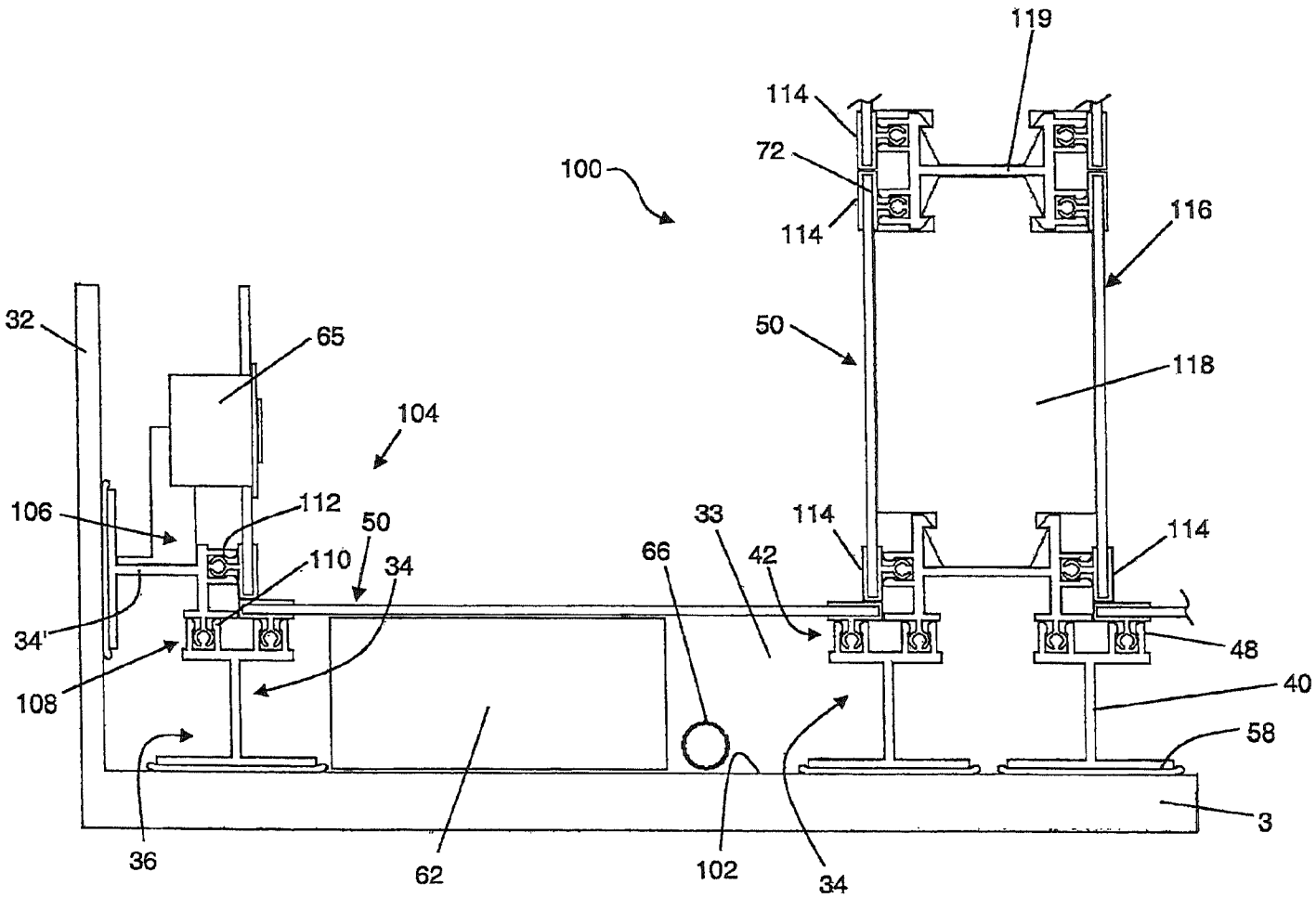
FIG. 11 generally represents one embodiment of a wall construction system according to the present invention.

FIG. 11 generally represents one embodiment of a wall construction system 100 according to the present invention, configured similar to the ceiling construction system 30 and coupled to a similar primary structure or base member 32. In this regard, the elongated structural support members 34, or rails, are configured to be fastened to a solid wall surface 102 or similar base member. As with the ceiling construction system 30, there are several types of support members 34 that are configured to support a wall panel or structure 42. It is envisioned that the wall surface 102 is brick, stone, block, wood, plaster, wallboard, or similar construction such that the flat mounting surface 36 of the support member 34 is glued or mechanically fastened to the wall surface 102. This coupling web 36 is similarly coupled to a support member mating feature or coupling mechanism 42 through a stringer 40. The wall support structure 50 may be board made of PVC material, pegboard, wood laminate, or similar construction material as described above.

FIG. 11 additionally illustrates a second type of support member 34' that is configured to be coupled to an adjacent support member 34 to form a corner construction assembly 104. The corner construction assembly 104 positions a pair of perpendicularly opposed coupling mechanisms 106, 108 that are configured to couple a pair of female and male coupling members 110, 112 respectively in a perpendicular fashion. It is envisioned that the wall construction system 100 may also include the use of wall structures that do not have an integrally formed coupling mechanism 56. In this instance, an end piece coupling member 114 is used. Preferably, the end piece coupling member 114 has means for receiving an edge region 72 of a wall support member 50, such as a longitudinally extending receiving channel, configured to slidingly receive and secure an edge 72 of the wall structure 50 to a support member 34. As shown, the space between the wall structure 50 and the base surface 102 forms a defined cavity 33 that can conceal items such as HVAC ducts 62, wall sockets 65, water or gas pipes 66, insulation materials, and the like.

In certain embodiments, it may be desired to incorporate room partitions 116 that physically extend outward from a main portion of the wall structure 100 operable to separate a larger area into one or more smaller areas. The room partitions generally include the use of various combinations of similar wall structures 50 support members 34, 34'. In various embodiments, one can incorporate spacer materials 118 that are disposed between the surface panels 50 of the partition 116. Non-limiting examples of spacer materials 118 typically include foam sound or thermal insulation that serves to audibly separate one room from another. In certain embodiments, the wall structures 50 couple to support members 34, 34' that are additionally configured to couple with the spacer materials 118 with a suitable coupling mechanism 119.

Figure 12:
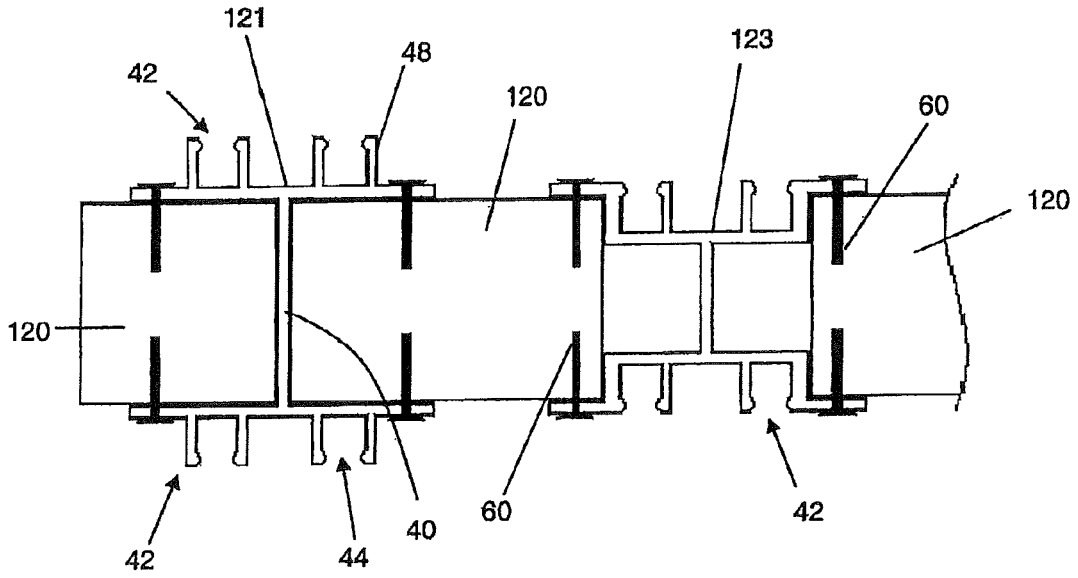
FIG. 12 represents an alternate wall construction system using 2×4 studs.

As best shown in FIG. 12, the support members 34 can be designed and configured to couple with standard construction materials such as a 2×4 stud member 120. The 2×4 stud members 120 can be conventionally used as normal to frame a given space. As can be seen, modified support members 121, 123 provide support member coupling mechanisms 42 on both ends of the support member 121, 123 to incorporate the components of the system 100 as described above and below. It should be understood that the support members can have outwardly extending 121 or inwardly extending 123 coupling mechanisms, or a combination thereof.

Figure 13:
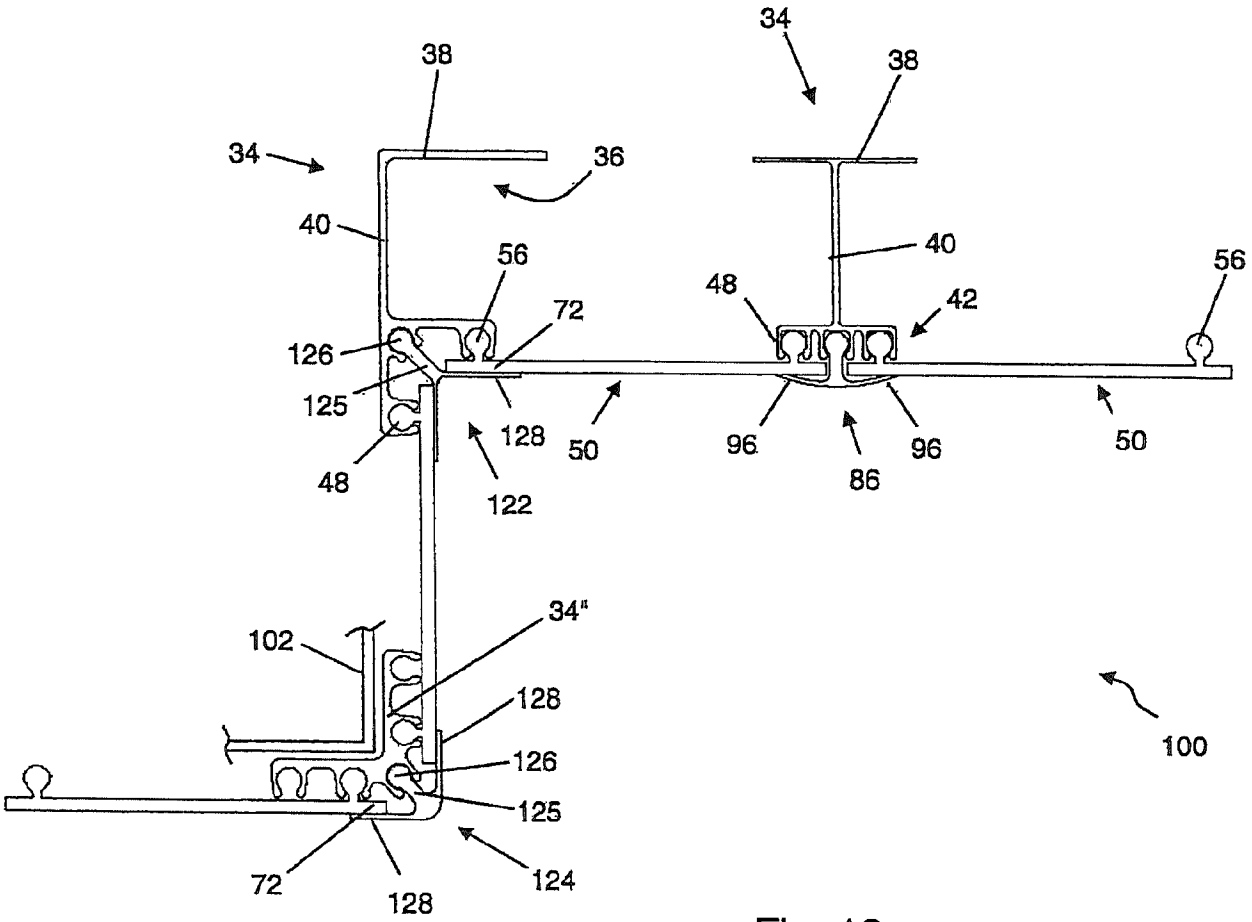
FIG. 13 illustrates various interior and exterior corner members according to one embodiment of the present invention.

As best seen in FIG. 13, the various support members 34, 34" may be directly coupled to a bearing surface of a wall or ceiling 102 without the use of a stringer member 40. In various embodiments, the interior and exterior corner trim members 122, 124 can be provided with mounting features configured to couple interior and exterior corner seams. These members 122, 124 typically have a stringer portion 125 and a corner coupling mechanism 126 at a proximal end of the stringer portion 125. At the distal end are a pair of end members 128 configured to cover a gap between the surface panels 50 and preferably abut and/or support the edges 72 of the wall structures 50 for an aesthetically pleasing sealed finish.

Figure 14:
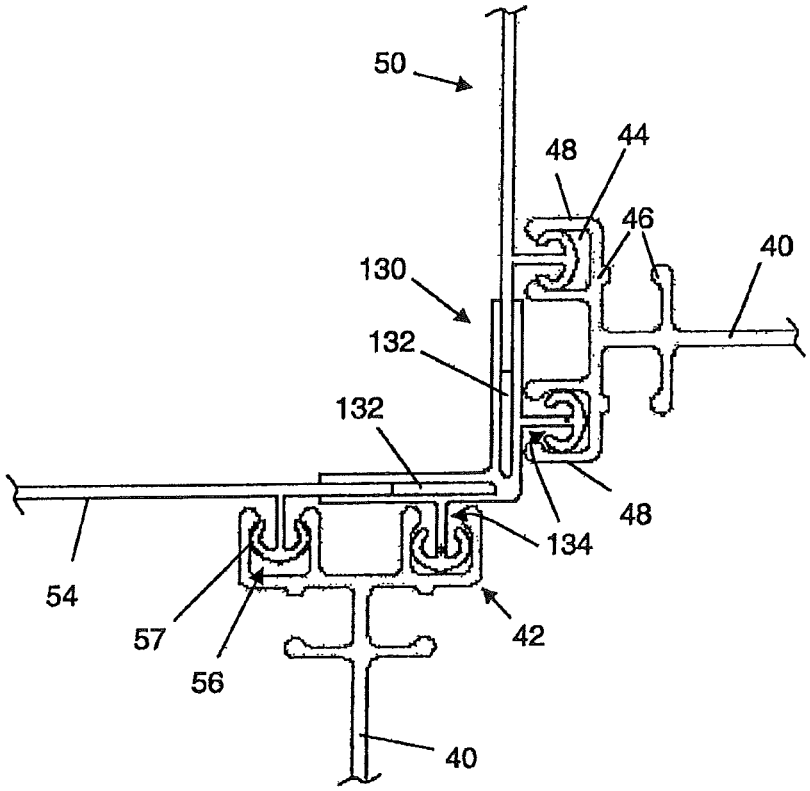
FIG. 14 illustrates a modified interior corner member.

FIG. 14 illustrates the use of a modified corner member 130. As shown, the corner member comprises a pair of longitudinally extending receiving channels 132 configured to slidingly receive and secure an edge 72 of the wall structure 50. As shown in one embodiment, the corner member 130 further has a pair of coupling mechanisms 134 operable to couple with the support members 34.

Figure 15A:
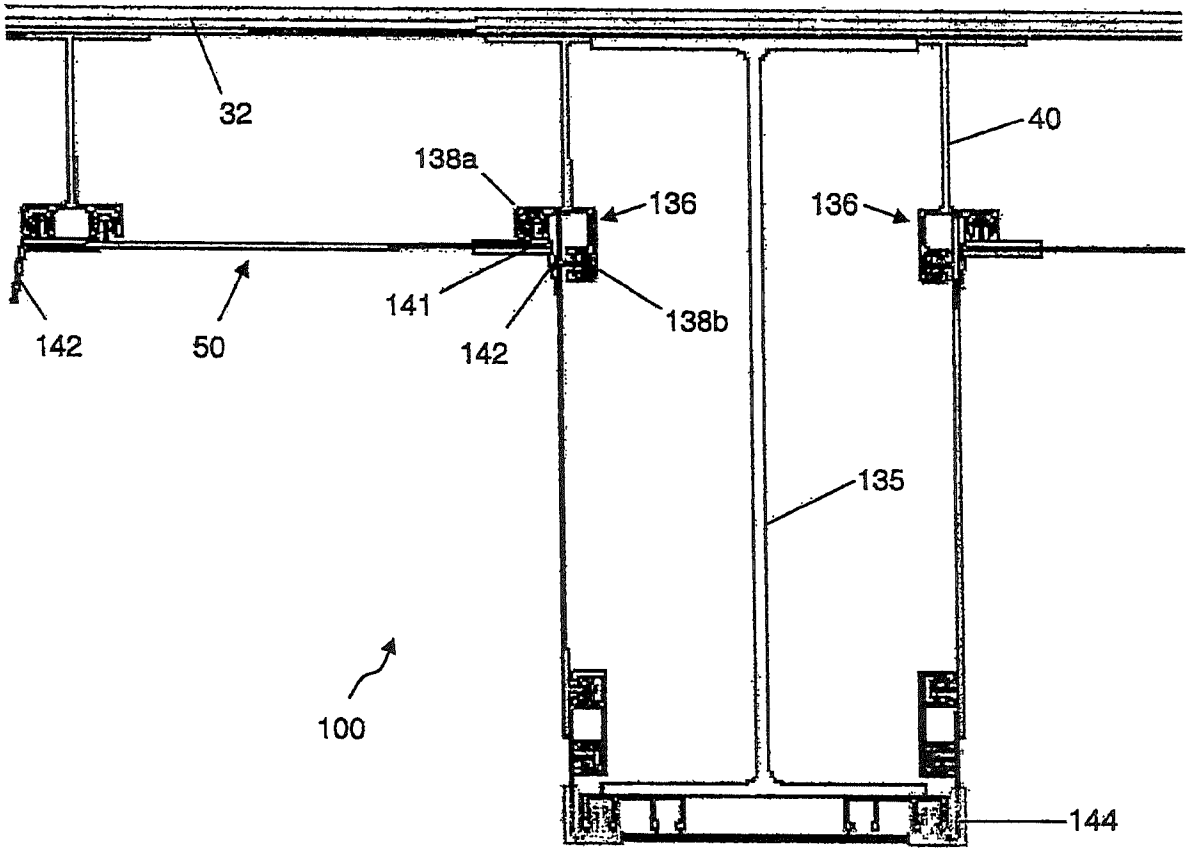
FIGS. 15*a* and 15*b* illustrate a wall construction system for use around an I-beam structure.
Figure 15B:
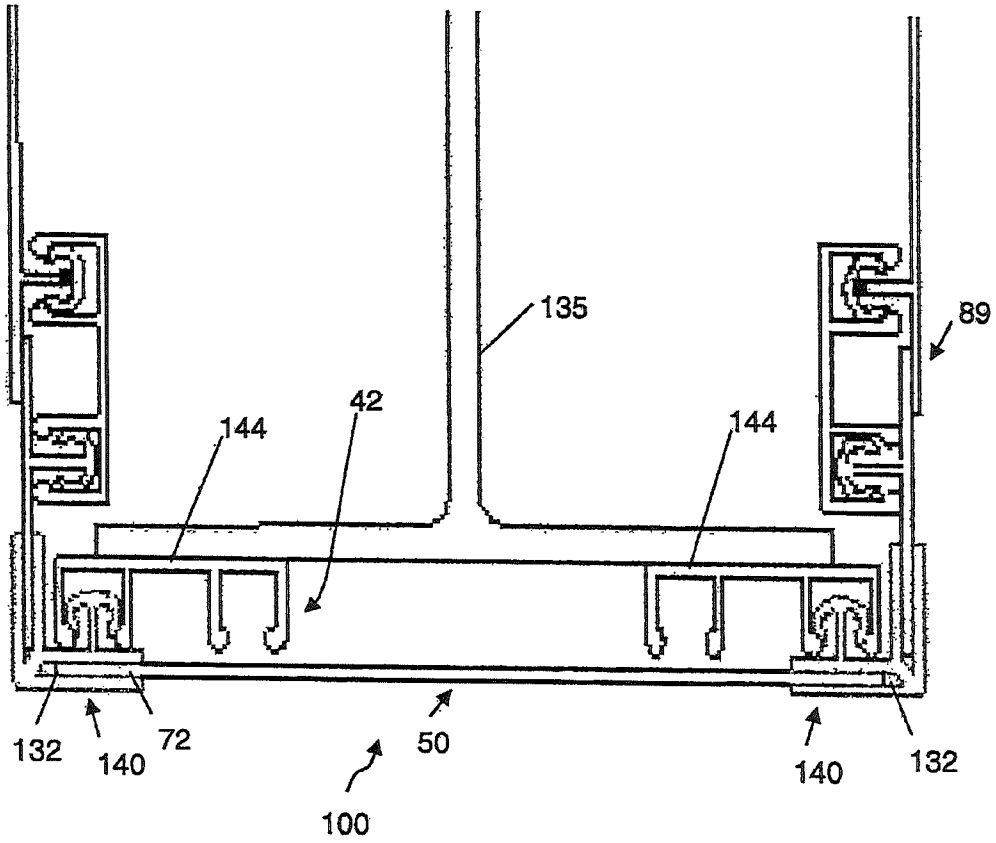

FIGS. 15*a* and 15*b* represent the use of the wall construction system 100 to surround an I-beam structure 135. As can be seen, the system 100 utilizes modified corner mounting support members 136 that have coupling mechanisms 138*a*, 138*b* located perpendicular to one another. Additionally shown is a first angular corner member 140 having a receiving channel 141 adjacent a biased corner flange 142. Also shown is another L-shaped corner member 144. As best seen in FIG. 15*b*, the L-shaped corner member has a pair of coupling flanges defining elongated receiving channels 132 configured to slidingly receive and secure an edge 72 of the wall structure 50. Additionally shown are coupling members 144 that are adhered directly to the I-beam 135 using adhesive.

Figure 16:
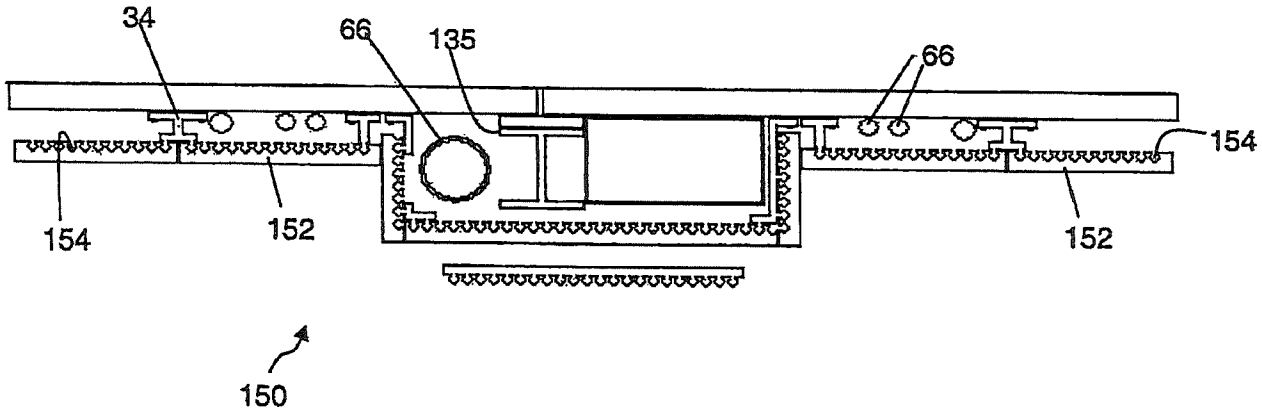
FIG. 16 represents an alternate construction system assembly.
Figure 17A:
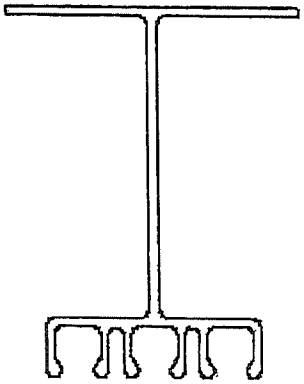
FIGS. 17*a*-17*m* illustrate cross-sections of selected variations of the support members.
Figure 17B:
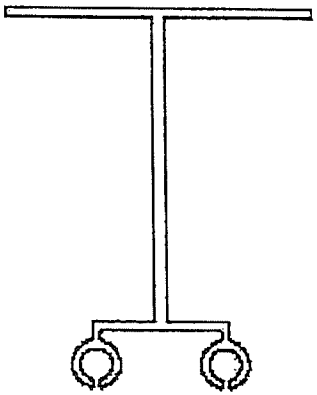
Figure 17C:
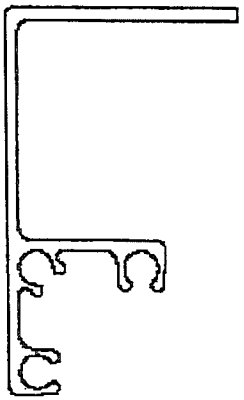
Figure 17D:
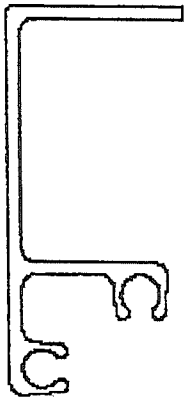
Figure 17E:
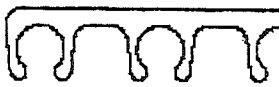
Figure 17F:
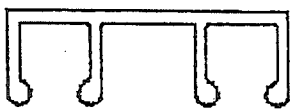
Figure 17G:
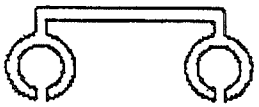
Figure 17H:
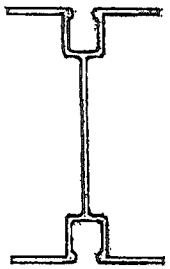
Figure 17L:
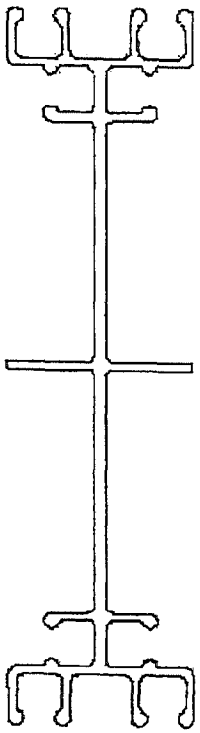
Figure 17K:
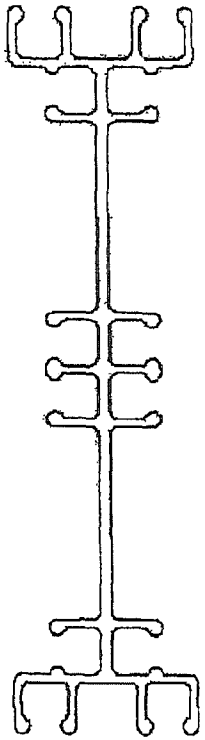
Figure 17I:
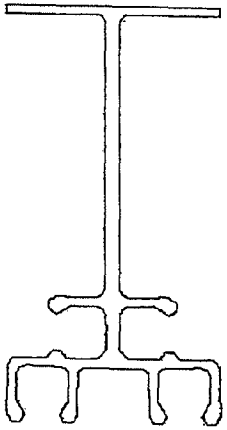
Figure 17J:
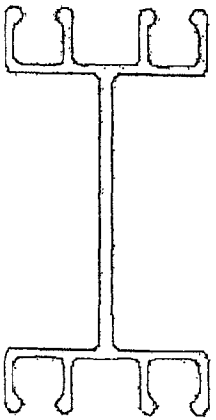
Figure 17M:
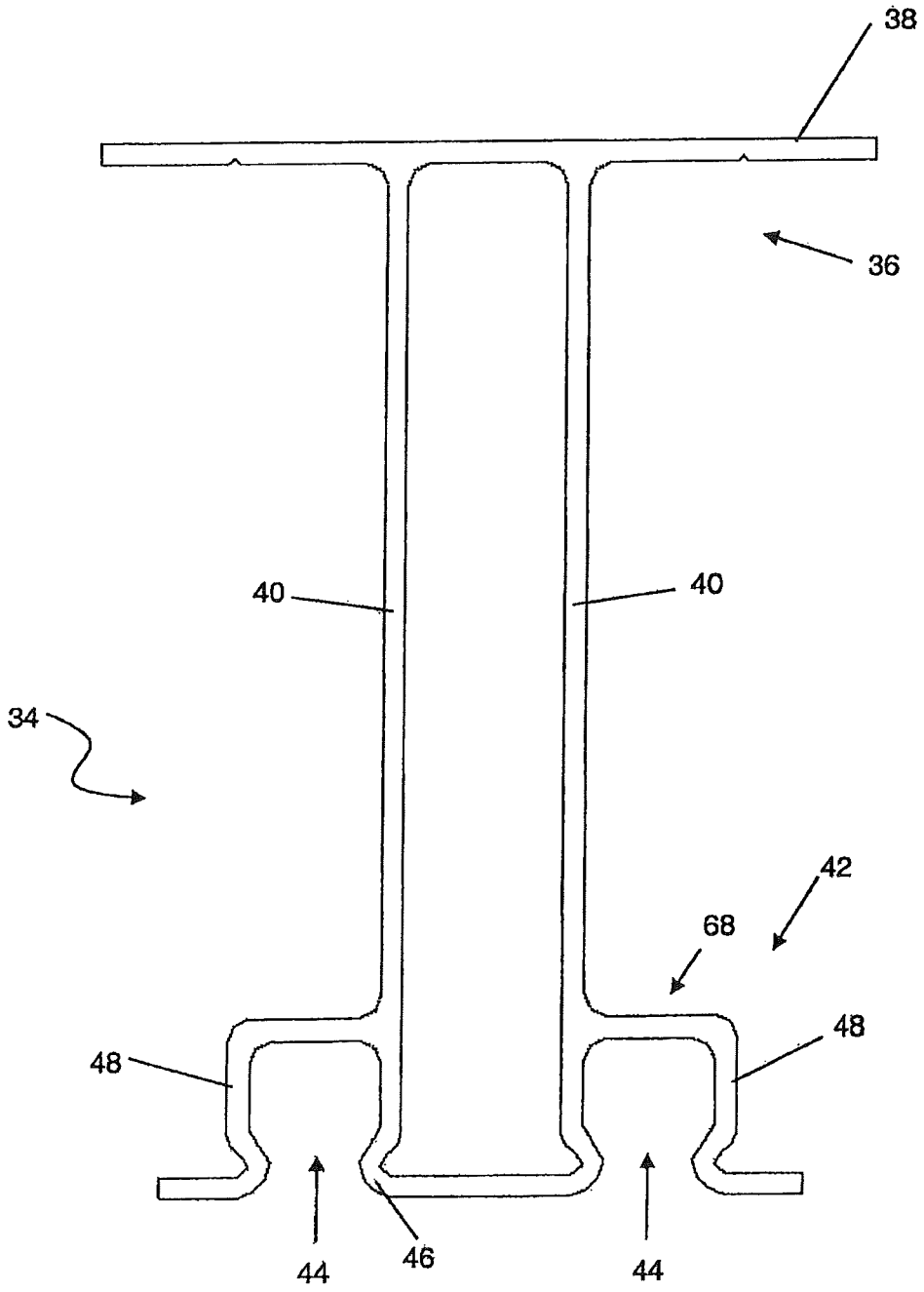

FIG. 16 represents an alternate construction system 150 showing the use of an alternate type of panel or wall structure 152. The alternate wall structure 152 defines a plurality of coupling slots 154 configured to mate with the coupling features of the various support members 34. In this regard, the coupling mechanisms 42 of the support members may include a key-shaped member which is configured to interlock with the coupling slots 154 of the alternate wall structures 152. In various embodiments, the support members 34 and wall structure coupling mechanisms each have a plurality of corresponding attachment sites, thus minimizing any wasted material due to inexact measurements or the like.

FIGS. 17*a*-17*m* represent cross-sections of selected variations of the support members 34, 34', 34" according to the principles of the present invention. As can be seen, the coupling mechanisms 42 can either have a male or female coupling configuration, or any combination thereof. Additionally, these mechanisms 42 can be formed having features offset perpendicular to one another that allows for perpendicular joining of surface components. In various embodiments, it may be desirable to use more than one support member in series. In this manner, one of the support members serves as a spacing extension member configured for positioning between a support member 34 and the wall structure 50 when extra length is needed. In certain embodiments, the support member has more than one stringer member 40.

Various support members 34' can be used to couple various other support members 34 together to provide mounting points for the wall structures 50. It should be understood that they can be used in combination to form complex support structures as desired for the particular use or application. In this regard, it should be understood that the various deformable male and female coupling members are interchangeable with one another and all of the various combinations are within the scope of the present invention. These coupling members allow for the disengagement of the members when a predetermined load is applied to the fascia components 42.

FIGS. 18*a*-18*i* represent cross-sections of various couplings, corner members, and trim members as shown in FIGS. 1-16. It should be understood that the couplings and members can be used both singly and in combination with one another, all of which are contemplated by the present invention.

Figures 19A, 19B, 19C:
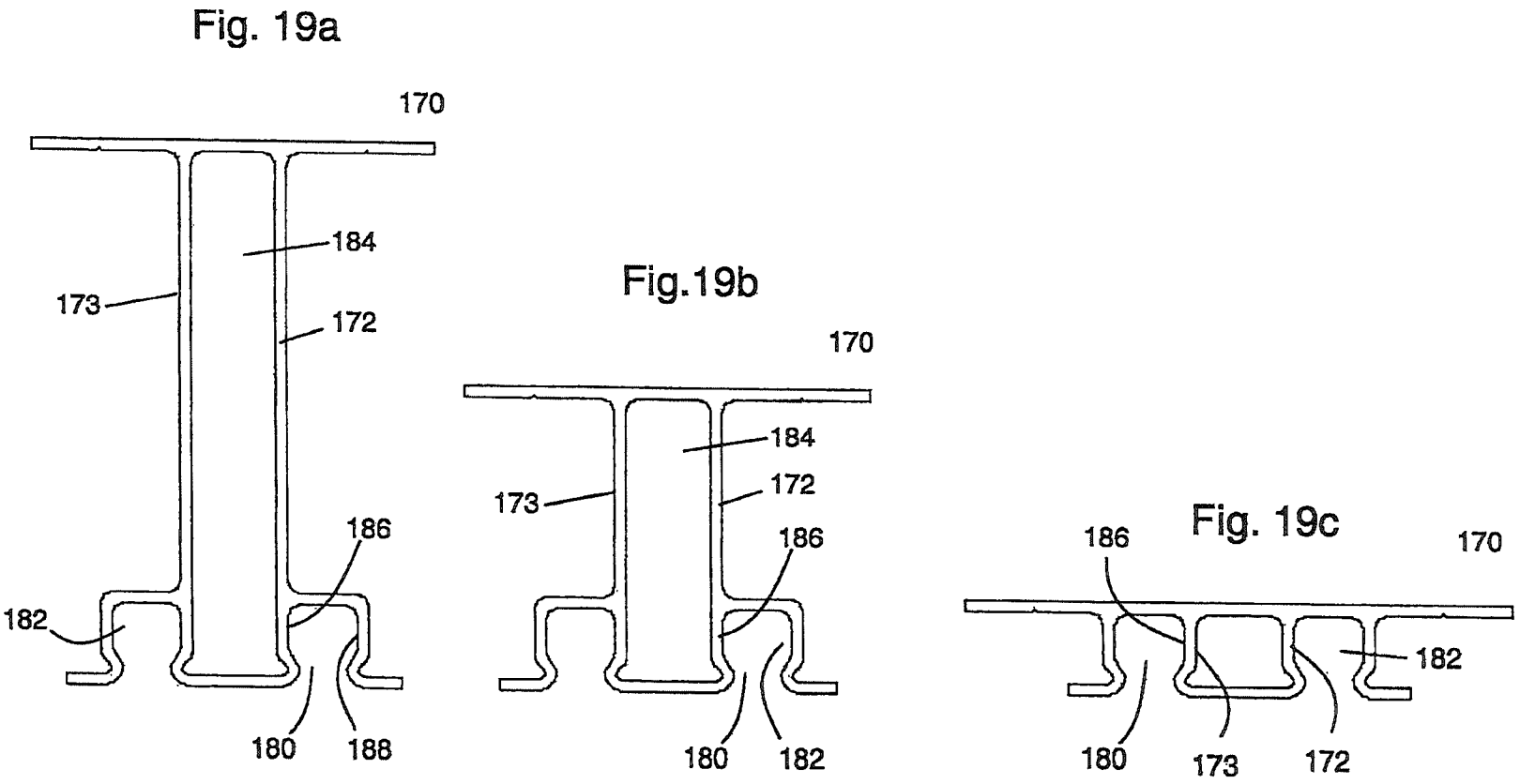
FIGS. 19*a*-19*c* represent a set of support members having varying spanner lengths.

FIGS. 19*a*-19*c* represent a set of supporting members having varying spanner lengths according to the present teachings. Shown is a mounting member 170 having a pair of stringer members 172. The stringer members 173 are generally parallel and coupled together at a first mounting end of 174. At a second end, the stringer members 172 are tied together with a coupling member 174. The stringer members 172, coupling member 179, and mounting end 174 form a closed box section 176 that can span the length of the mounting member 170. Disposed at the second end is the first and second coupling mechanisms 180. The coupling mechanism defines a pair of coupling channels 182. The coupling channels 182 can have generally square cross-sections 184 and are configured to couple with the panel coupling members as generally described and shown above. The square cross-sections 184 have three generally flat coupling sides. One side 186 is defined on a portion of the stringer members 172. As shown in FIG. 19*c*, the stringer member 172 can form the entire length of the flat coupling side 186. The second and third coupling sides 188 can be cantileveringly attached to the stringer member 172. The second coupling side is generally perpendicular to the first and second coupling sides. Disposed between the first and third flat sides is a pair 192 of coupling surfaces.

Figure 20:
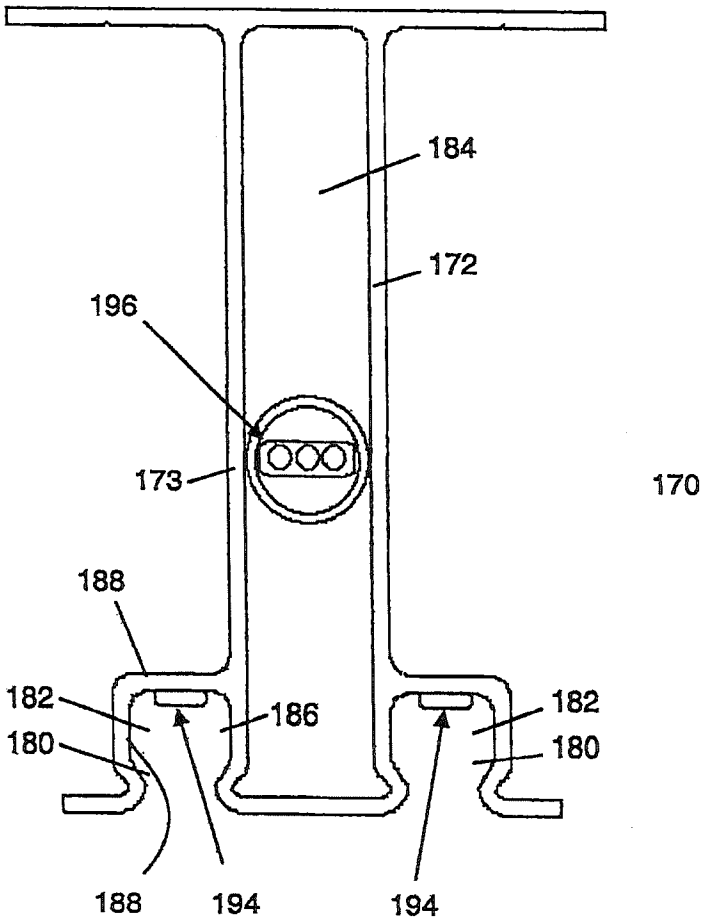
FIG. 20 represents a support member with associated electrical supply.

As best seen in FIG. 20, the support members can have associated electrical contacts 194 and transmission lines 196. The lines or wires can be disposed within the closed channel. The contacts 194 can be found disposed within the square coupling channels 82. These contacts 194 can be used to transmit data or power to lighting and can run the entire length of the channel or can be intermittently disposed therein.

Figure 21:
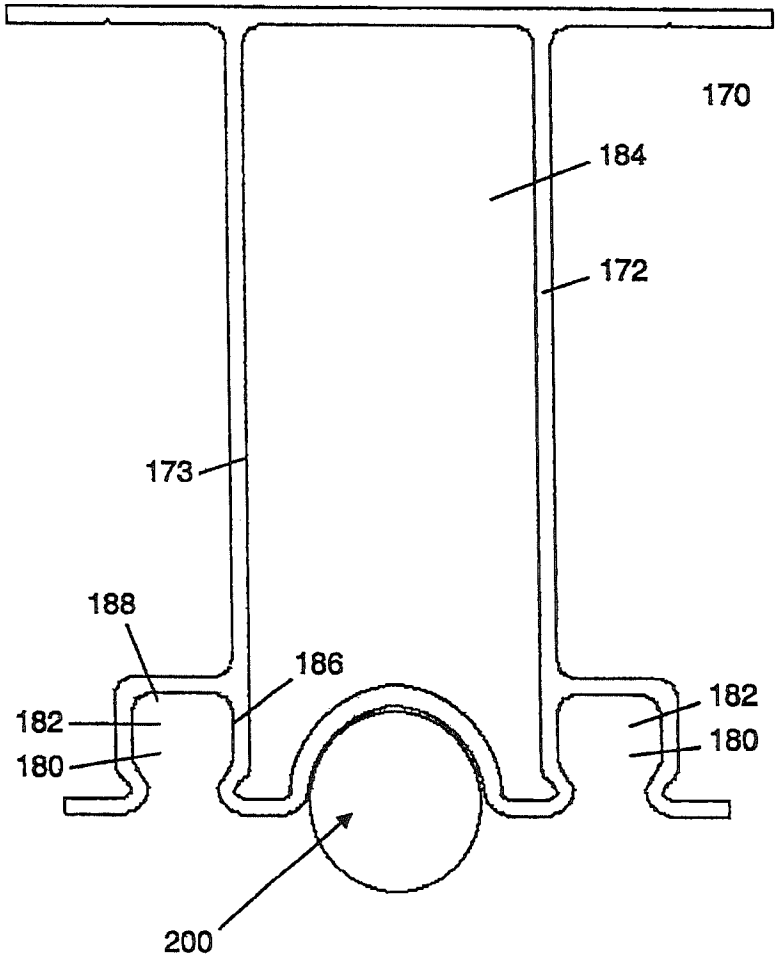
FIG. 21 represents a support member having an associated lighting rod.
Figure 22:
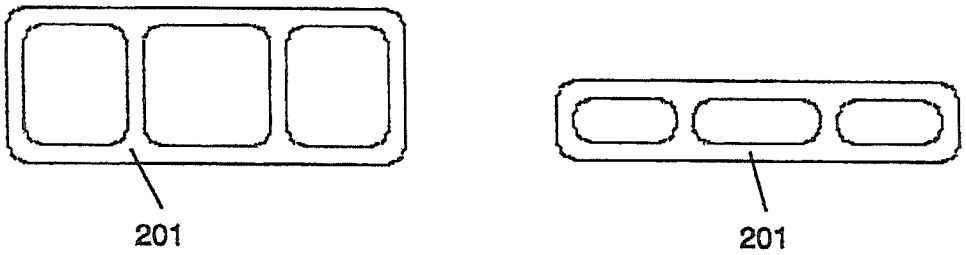
FIG. 22 represents a kit of polymer space elements.

FIG. 21 represents a support member having an integral light producing member 200. The light 200 is coupled to the second end of the closed box. As described and shown above, the coupling members can be used to couple ceiling members thereto. FIG. 22 represents a kit of spacers or shims 201 which can be positioned between the support member and the ceiling.

Figure 23A:
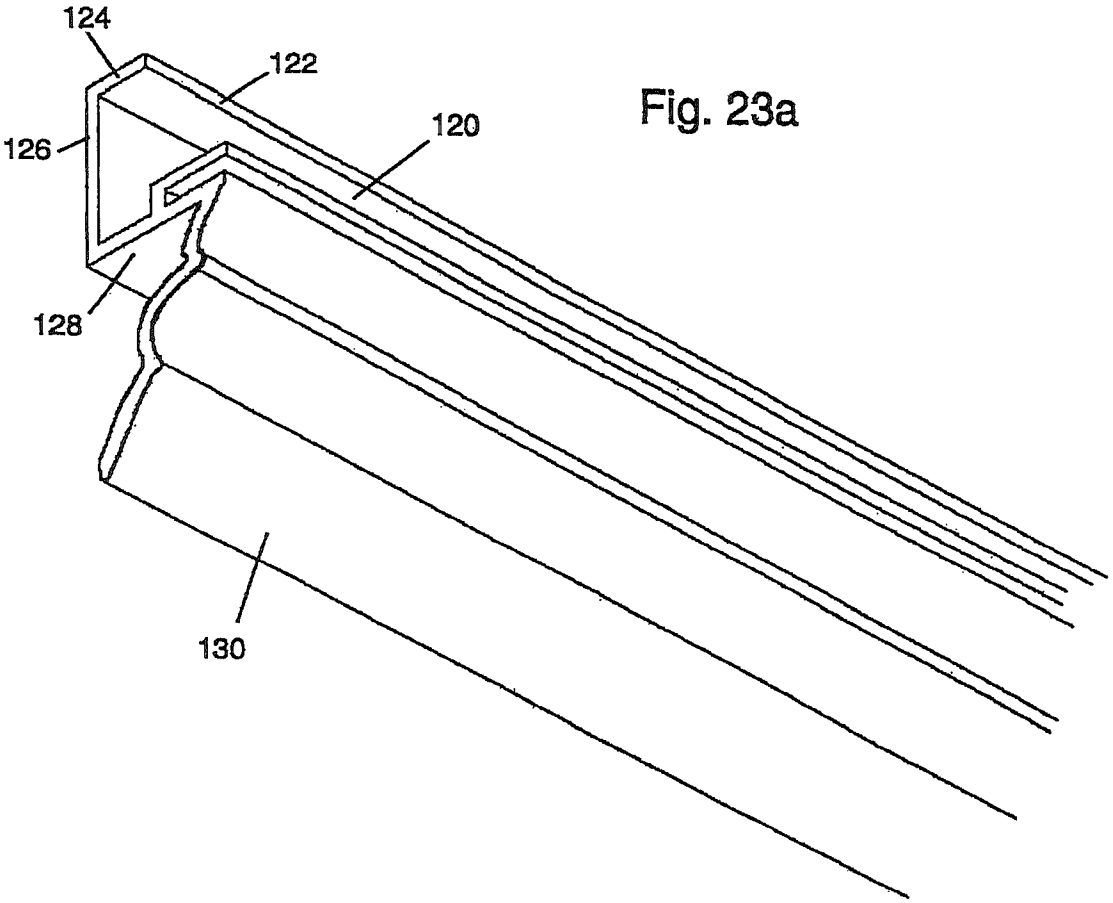
FIGS. 23*a* and 23*b* represent a crown molding element with associated coupling features.
Figure 23B:
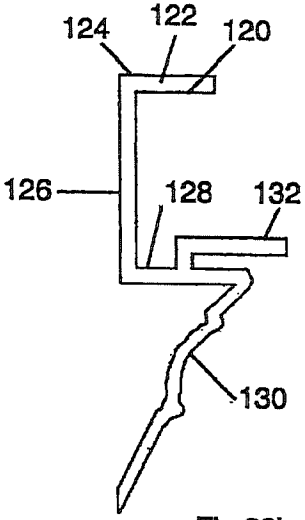

FIGS. 23*a* and 23*b* represent side and perspective views of a crown molding member 120 according to the present teachings. The member 120 has a stand-off portion 122 which locates the mounting 120 a fixed distance from an upper mounting surface 124. Generally perpendicular to the stand-off portion is a wall engagement surface 126. Disposed between the wall engagement surface 126 is a stand-off flange 128 which properly spaces the decorative surface 130. Associated with the stand-off flange 128 is a coupling member 132 configured to couple the crown molding to a ceiling member (see above).

Figure 24:
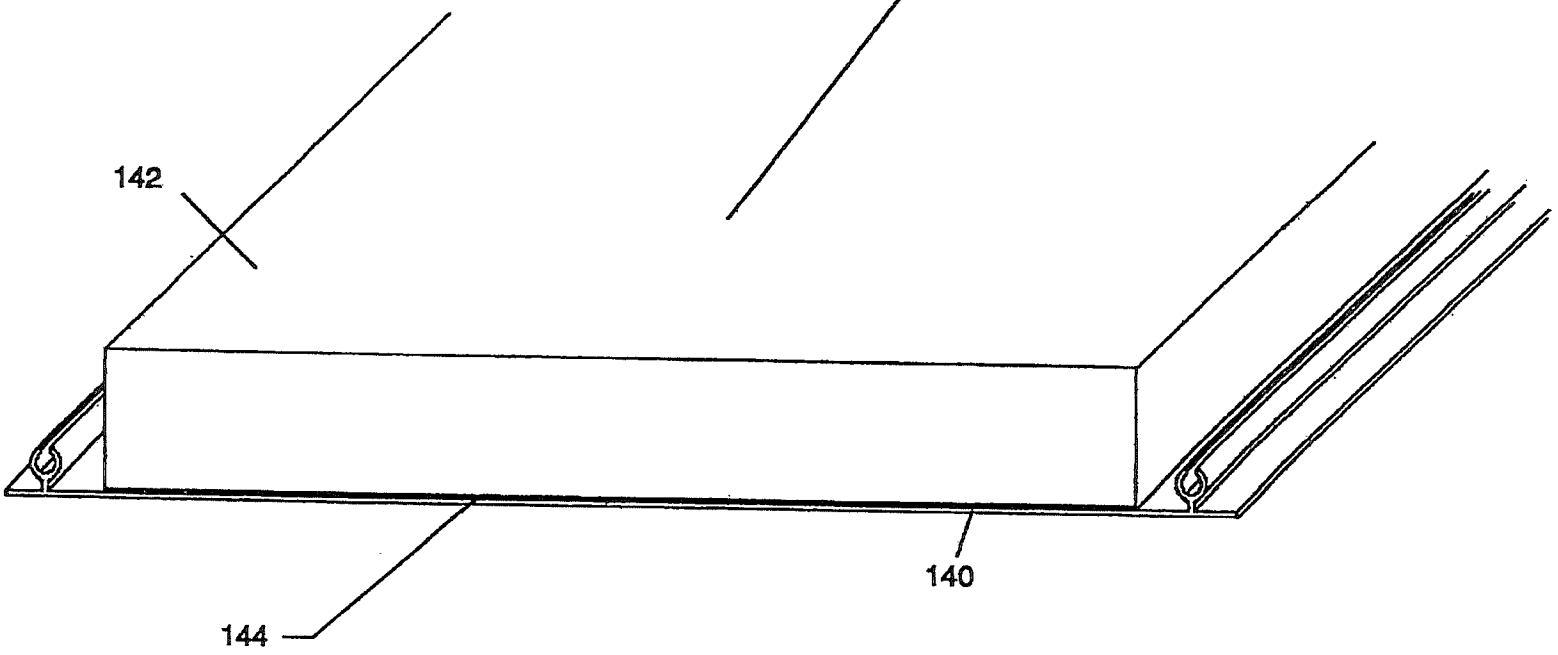
FIG. 24 represents a perspective view of a panel member having an associated insulation pad.

As shown in FIG. 24, a ceiling member 140 having an associated insulation material 142 disposed thereon. Between a layer of chopped fiber insulation 142 and the panel 140 can be a layer of adhesive 144. The insulation layer can be formed of pressed polymer, fiber, glass fibers, or mixtures thereof.

Figure 25B:
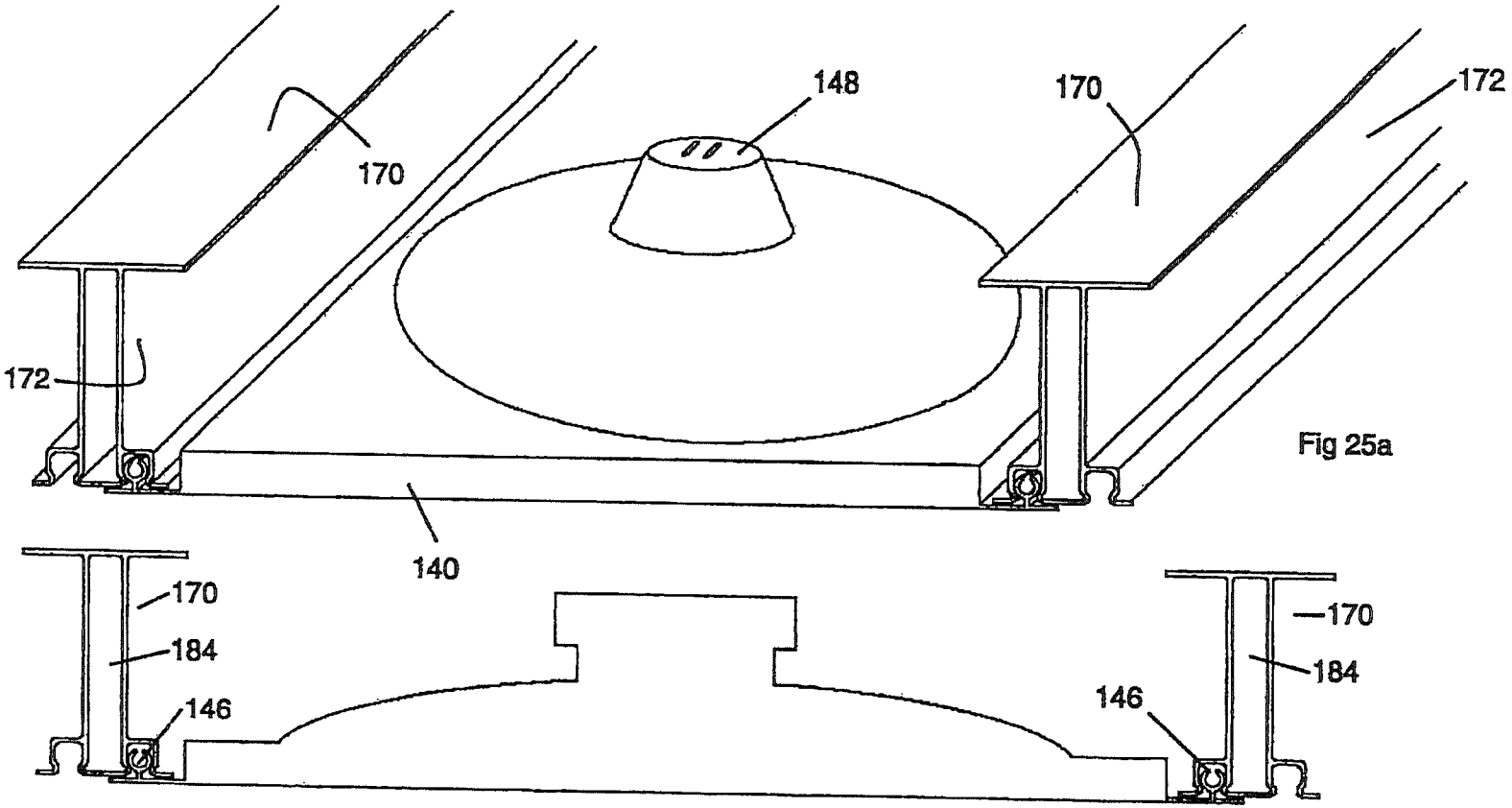

FIGS. 25*a* and 25*b* represent side and perspective views of the light support members coupled to the support members described above. Shown is a panel member 140 having an incorporated light reflector. The panel member 140 has coupling flanges 146 as described above which couple the panel to the coupling member 170. Also shown is a pair of connectors 148 which electrically couple the fixture to a power source. It is envisioned the light element can be a low voltage light emitting diode. The LED can be powered through the contacts described in FIG. 20.

The description of the invention is merely exemplary in nature and, thus, variations that do not depart from the gist of the invention are intended to be within the scope of the invention. Such variations are not to be regarded as a departure from the spirit and scope of the invention. For example, while the present invention generally refers to a housing construction system for providing interior surfaces, such as drop ceilings and other wall covering structures, it is contemplated that the present invention can also be used to provide exterior surfaces, such as for use under decks and the like.

What is claimed is:

1. A construction kit for securing a secondary ceiling structure to a base member, the kit comprising:

a plurality of elongated structural support members, each said elongated structural support members comprising a base coupling portion having first and second edges and a planar mounting surface therebetween, said mounting surface configured to fixedly attach to the base member, and at least one support member coupling mechanism integrally formed with and longitudinally extending a length of said support member;

a plurality of substantially planar body structures, each said body structure having an interior major surface having a body structure coupling mechanism and an opposite exterior major surface, said body structure coupling mechanism extends substantially an entire length of said planar body structures, and having two substantially parallel members extending from said planar body structures and forming the length of a flat coupling side, said substantially parallel members having first respective ends attached to said planar body structures, whereby the, substantially parallel members and planar body structures form a channel;

each elongated structural support members further comprising a supporting member having a support surface cantileveringly coupled to and extending substantially perpendicular from each substantially parallel members between the first and second ends of each respective substantially parallel member, and a generally circular coupling member extending substantially perpendicular from an end of said support surface, said substantially parallel members, said body structure coupling member channel receiving said generally circular coupling member.

2. The construction kit according to claim 1, wherein said channel further comprises integral locking projections, said channel extending an entire length of said elongated support member.

3. The construction kit according to claim 2, wherein said body structure coupling mechanism comprises a male coupling member that extends an entire length of said body structure.

4. The construction kit according to claim 1, wherein at least one of said support member and body structure coupling mechanisms is deformable.

5. The construction kit according to claim 1, wherein at least one of said support member and body structure coupling mechanisms comprise an integral locking projection.

6. The construction kit according to claim 1, further comprising a plurality of mechanical fasteners configured to secure said base coupling portion to the base member.

7. The construction kit according to claim 1, further comprising at least one sealing trim member selected from the group consisting of an end member, an interior corner member, an exterior corner member, and a center seam member.

8. The construction kit according to claim 1, wherein said support member coupling mechanism comprises at least one female receiving member and said body structure coupling mechanism comprises at least one corresponding male coupling member.

9. The construction kit according to claim 1, wherein said support member and body structure coupling mechanisms comprise a plurality of corresponding attachment sites.

10. The construction kit according to claim 1, further comprising at least one spacing extension member configured for positioning between said support member and said body structure.

11. The construction kit according to claim 1, wherein said support members further comprise an electrically conductive member.

12. A ceiling construction assembly for securing a ceiling structure to a ceiling base member, the assembly comprising:

a substantially planar ceiling structure, said ceiling structure having an interior major surface and an opposite exterior major surface, said interior major surface having at least one outwardly facing, deformable body structure coupling mechanism integrally formed thereon that extends substantially an entire length of said ceiling structure, said ceiling structure coupling mechanism includes a base, a first planar deformable member extending from said base, a second planar deformable member extending from said base, and a gap between an end of said first planar deformable member opposite to said base and an end of said second planar deformable member opposite to said base;

a plurality of monolithic structural support members configured to fasten respective said ceiling structure a fixed distance from the base member, each of said support members comprising a base coupling portion having first and second edges and a substantially planar mounting surface therebetween, at least one support member coupling mechanism longitudinally extending a length of said support member and configured to removably fasten said body structure to said support member, and a fixed length member connecting said base coupling portion to said support member coupling mechanism;

wherein said at least one member comprises two substantially parallel members extending from said base coupling portion, said substantially parallel members having first respective ends attached to said base coupling portion and second ends connected to a strip, whereby said base coupling portion, the substantially parallel members and strip form an enclosure;

said support member further comprising a supporting surface extending substantially perpendicular from each support member between the first and second ends of each respective substantially parallel member, and the ceiling member extending substantially perpendicular from an end of said support surface, said supporting surface forming a generally circular surface engaging said coupling mechanism, said channel extending substantially an entire length of said ceiling structure and parallel to said body structure coupling mechanism such that said body structure coupling mechanism is configured to interlock with one of said channels substantially along an entire length of said support member, wherein said mounting surface is configured to be coupled to the ceiling base member.

* * * * *